United States Patent [19]

Kado et al.

[11] 4,204,862

[45] May 27, 1980

[54] AUSTENITIC HEAT-RESISTANT STEEL WHICH FORMS $AL_2O_3$ FILM IN HIGH-TEMPERATURE OXIDIZING ATMOSPHERE

[75] Inventors: Satoshi Kado; Taketomo Yamazaki, both of Fujisawa; Tetsu Sakamoto, Machida; Mikio Yamanaka, Yamato; Kotaro Yoshida, Sagamihara, all of Japan

[73] Assignee: Nippon Steel Corporation, Tokyo, Japan

[21] Appl. No.: 893,688

[22] Filed: Apr. 5, 1978

Related U.S. Application Data

[63] Continuation-in-part of Ser. No. 737,197, Oct. 29, 1976, abandoned.

[30] Foreign Application Priority Data

Oct. 29, 1975 [JP] Japan ..... 50-129312

[51] Int. Cl.[2] ..... C22C 38/06

[52] U.S. Cl. ..... 75/124; 75/122; 75/128 E; 148/31.5; 148/38

[58] Field of Search ..... 75/124, 122, 134 F, 75/128 G, 128 Z, 128 T, 128 E; 148/38, 31.5

[56] References Cited

U.S. PATENT DOCUMENTS

| | | | |
|---|---|---|---|
| 3,131,055 | 4/1964 | Behar | 148/135 |
| 3,362,813 | 1/1968 | Zolkowski | 75/128 R |
| 3,420,660 | 1/1969 | Kawahata et al. | 75/122 |
| 3,619,180 | 11/1971 | Staehle | 75/128 R |
| 3,754,898 | 8/1973 | McGurty | 75/124 |
| 4,086,085 | 4/1978 | McGurty | 75/122 |

*Primary Examiner*—Arthur J. Steiner

*Attorney, Agent, or Firm*—Wenderoth, Lind & Ponack

[57] ABSTRACT

An austenitic heat-resistant steel which forms an oxide film mainly composed of $Al_2O_3$ in a high-temperature oxidizing atmosphere, consisting essentially of not more than 0.2% of C, not more than 1.0% of Si, not more than 2.0% of Mn, 12 to 37% of Ni, 9 to 25% of Cr, more than 4.5 but not more than 6% of Al, and at least one member selected from the group consisting of Ti, Nb and Zr in a total amount of not more than 0.8%, with the balance being Fe; the δ-ferrite value of this steel, calculated from the formula set forth below, is from 0 to 7.9; this steel is removed of an internal oxide layer which has been formed just below the steel surface during hot working.

$$\delta\text{-ferrite value} = 3.0\{(\%Cr) + 1.5(\%Si) + 2.5(\%Al)\} - 2.8[(\%Ni) + 0.5(\%Mn) + 30\{(\%C) + (\%N) - 12\Sigma \frac{Wi}{Mi}\}] - 19.8$$

where Wi and Mi represent, respectively, the percent by weight and the atomic weight of Ti, Nb and Zr, and when the term $$\{(\%C) + (\%N) - 12\Sigma \frac{Wi}{Mi}\}$$

is negative this term is regarded as zero. This steel composition may contain one or more rare earth elements such as Y, Ce and La in a total amount of not more than 0.08%.

8 Claims, 7 Drawing Figures

Fig. 2. (1)
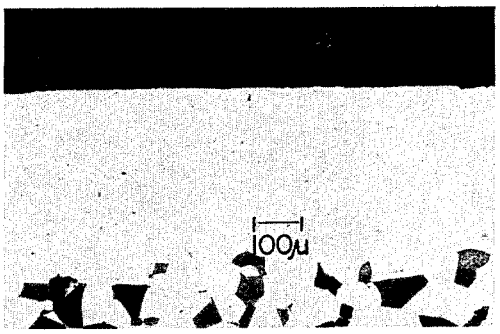
Fig. 2. (2)
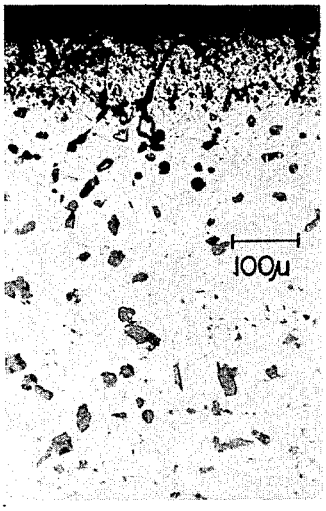
Fig. 2. (3)
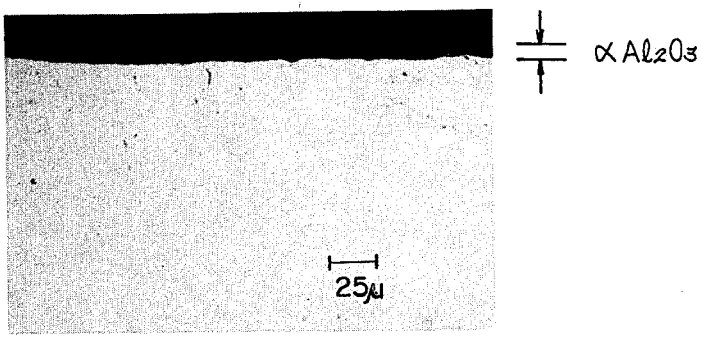

AUSTENITIC HEAT-RESISTANT STEEL WHICH FORMS $AL_2O_3$ FILM IN HIGH-TEMPERATURE OXIDIZING ATMOSPHERE

CROSS-REFERENCE TO RELATED APPLICATION

This application is a continuation-in-part of our copending application Ser. No. 737,197, filed Oct. 29, 1976, now abandoned.

BACKGROUND OF THE INVENTION

1. Field of the Invention

The present invention relates to an austenitic heat-resistant steel which forms a uniform $Al_2O_3$ film on its surface in a high-temperature oxidizing atmosphere, exhibits oxidation resistance and high-temperature corrosion resistance similar to Fe-Cr-Al steels, and also shows sufficient hot workability for permitting roll-breaking on a large production scale and good weldability.

2. Description of Prior Art

Conventional Fe-Cr-Al steels which have been widely used as heating elements form $Al_2O_3$ film on their surface in a high-temperature oxidation atmosphere, and show resistance against attacks by sulfur and vanadium, but show defects inherent to ferritic steels, such as poor strength at high temperatures, and therefore their applications have been considerably limited.

Meanwhile, austenitic stainless steels show excellent high-temperature strength and cold workability, but their oxide films show poor resistance against spalling, and these steels have a defect that weight decrease is considerable when subjected to cyclic heatings and erosion.

In efforts to overcome these defects of austenitic heat-resistant steels, it has been proposed to add Al to Ni-Cr steels. For example, Japanese Patent Publication No. Sho 47-11576, British Pat. No. 1,147,574, French Pat. No. 1,555,208, and Japanese Laid-Open Patent Application Nos. Sho 48-30621, Sho 49-23125, Sho 50-24117 and Sho 50-51411 disclose such Al-added Ni-Cr steels as heat resistant steels, and Japanese Patent Publication Nos. Sho 34-2554 and Sho 47-23054, Japanese Laid-Open Patent Application No. Sho 48-13213 and German Pat. No. 2,135,180 disclose similar austenitic steels. Further, Japanese Patent Publication No. Sho 49-32685 discloses a ferrite-austenite heat-resistant steel, and various similar steels made by powder metallurgy and other special methods, as disclosed by Russian Pat. No. 287,316, have also been proposed.

All of the above known steels have Al addition not more than 4.5%, and by the Al addition oxidation resistance has been improved, but no uniform $Al_2O_3$ film is stably formed, and the film which is formed is composed mainly of a spinel oxide film of Fe, Ni and Cr, as is formed in ordinary austenitic stainless steels. This film is susceptible to spalling and easily permits permeation of oxygen and nitrogen, so that when the steels are used in a high-temperature oxidizing atmosphere, a thick internal oxide layer is formed in the matrix just below the external oxide film, and further, a substantial amount of crystalline TiN and AlN precipitates below the oxide layer.

For illustration of a typical example, FIG. 2(1) shows a cross-sectional view near the surface of 23Cr-24Ni-2Al steel after oxidation tests.

In the photograph, A represents a spinel oxide film of Fe, Ni and Cr, B represents a metallic layer having mainly $Al_2O_3$ distributed therein, and C represents an austenite phase in which AlN (larger precipitates) and TiN (smaller precipitates) are precipitated.

Although the above steels show better oxidation resistance than obtained by ordinary Ni-Cr steels, these steels still have the defect that they are susceptible to weight decrease due to spalling, and when used at high temperatures for a long time, a large amount of AlN precipitates to deteriorate the material quality and the effect of Al addition is thus gradually lost, and at a certain point oxidation progresses abruptly.

In order to overcome the above defect of Al-containing stainless steels, it has been proposed, in U.S. Pat. No. 3,754,898, to add a maximum of 5.5% of Al and a minimum of 0.1% of a rare earth element, such as Y, or an actinide element, so as to form a uniform film of $Al_2O_3$, thereby assuring excellent resistance to high-temperature corrosion such as caused by exhaust gases of automobile engines. However, the steel has been proved to afford no practical utility due to the fact that it cannot maintain sufficient hot workability for permitting roll-breaking on a large production scale, because of its relatively high Y content, and also the fact that it shows a high sensitivity to high-temperature cracking during welding, because of its fully austenitic structure.

SUMMARY OF THE INVENTION

Therefore, one of the objects of the present invention is to provide an austenitic heat-resistant steel containing more than 4.5% Al which stably forms and maintains a uniform film composed mainly of $Al_2O_3$ in a high-temperature oxidizing atmosphere, by giving special consideration to the surface condition of the steel, without addition of actinide or rare earth elements, such as Y, in such large amounts as cause deterioration of the hot workability, thereby preventing formation of the internal oxide layer and precipitation of AlN as mentioned before, and which prevents material deterioration during a long period of service at high temperature.

Another object of the present invention is to adjust the ferrite-austenite balance so as to positively precipitate the δ-ferrite phase in the welded portion, thereby improving the poor weldability of the conventional high-Al austenitic steels to a practically usable level.

In case of conventional austenitic heat-resistant steels, a film mainly composed of spinel oxides of Fe, Cr and Ni is formed, and this type of film does not show satisfactory spalling resistance and cannot completely prevent permeation of oxygen and nitrogen.

According to U.S. Pat. No. 3,754,898, 3.5 to 5.5% Al and 0.1 to 5% of rare earth elements such as Y, or actinide elements, are added so as to form a uniform film of $Al_2O_3$ on the austenitic steel. However, due to the addition of these elements, such as Y, in a minimum amount of 0.1%, the hot workability of the steel is so deteriorated that the steel cannot stand the roll-breaking which requires the highest grade of hot workability. Therefore, the steel has been proved to be unsuitable for mass production even though it can be manufactured on a laboratory scale, and in addition, the steel is defective in weldability due to its fully austenitic structure.

Therefore, the most important technical advantage of the present invention is that a uniform film of $Al_2O_3$ is stably formed on the surface of an austenitic steel by completely eliminating the internal oxide layer which is inevitably formed during the hot working step of this type of austenitic steel, without the necessity of adding rare earth elements such as Y, or actinide elements, or compounds thereof, which rather deteriorate hot workability of the steel if added in excessive amounts, so that mass production of this type of steel by roll-breaking has been made possible for the first time. Further, according to the present invention, the δ-ferrite value, calculated from a formula shown hereinafter, is adjusted to between 0 and 7.9, and thereby the steel of the present invention can maintain not only high-temperature strength and workability as excellent as those obtained by ordinary austenitic heat-resistant steels, but also weldability good enough for practical services.

Thus, the steel of the present invention is a heat-resistant steel having a combination of the favorable features of Fe-Cr-Al steels and austenitic heat-resistant steels, and affords good productivity as a multi-purpose steel.

The term "internal oxide layer" used in the present invention represents the combination of a metallic layer having mainly $Al_2O_3$ distributed therein and a layer containing precipitated AlN.

A typical steel composition according to the present invention is illustrated below, all percentages being by weight:

C: not more than 0.2%
Si: not more than 1.0%
Mn: not more than 2.0%
Ni: 12–37%
Cr: 9–25%
Al: more than 4.5% but not more than 6%
One or more of Ti, Nb, Zr: total of not more than 0.8%
Balance: Fe, and a δ-ferrite value, calculated from the formula set forth below, of from 0 to 7.9, said steel being removed of an internal oxide layer which has been formed just below the steel surface during hot working.

Further, one or more rare earth elements, such as Y, Ce and La, may be added to the above steel composition in a total amount of not more than 0.08% by weight, to improve oxidation resistance.

$$\delta\text{-ferrite value} = 3.0\{(\%Cr) + 1.5(\%Si) + 2.5(\%Al)\} - 2.8[(\%Ni) + 0.5(\%Mn) + 30\{(\%C) + (\%N) - 12\Sigma \frac{Wi}{Mi}\}] - 19.8$$

where Wi and Mi represent, respectively, the percent by weight and the atomic weight of Ti, Nb and Zr, and when $$\{(\%C) + (\%N) - 12\Sigma \frac{Wi}{Mi}\}$$

is negative, this term is regarded as zero.

BRIEF DESCRIPTION OF THE DRAWINGS

FIG. 2(1) is a photograph showing the metal structure near the surface of a conventional Ni-Cr-Al steel (No. 13 in Table 1) when heated at 1200° C. for 200 hours in air.

FIG. 2(2) is a photograph showing the metal structure near the surface of a steel (No. 2 in Table 1) when hot rolled, annealed and acid-pickled.

FIG. 2(3) is a photograph showing the metal structure near the surface of a steel (No. 2 in Table 1) when hot rolled, annealed, acid-pickled and directly cold rolled and annealed.

FIG. 2(4) is a photograph showing the metal structure near the surface of a steel (No. 2 in Table 1) according to the present invention when hot rolled, annealed, removed of the internal oxide layer by grinding, cold rolled, annealed and acid-pickled, and further heated at 1200° C. in air for 200 hours.

DETAILED DESCRIPTION OF THE INVENTION

Figure 1:
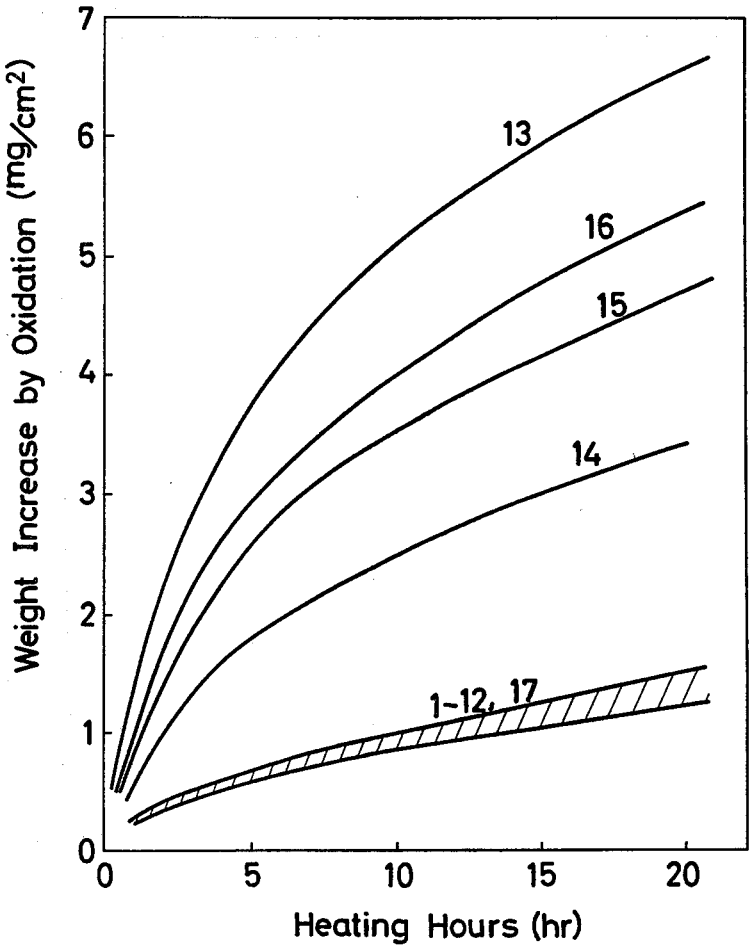
FIG. 1 is a graph showing weight changes of various steel samples when heated at 1200° C. for 20 hours in air.

As understood from the above description, the steel of the present invention is basically an austenitic heat-resistant steel, but contains a limited amount of delta ferrite phase, because a small amount of delta ferrite phase produced in the welded portion can prevent hot cracking due to the welding and restrict the grain growth during high-temperature heating.

In the present invention, the δ-ferrite value calculated by the formula set forth hereinbefore should be adjusted to within the range from 0 to 7.9% in order to precipitate a small amount of δ-ferrite phase in the welded portion. Therefore, it is necessary to assure that each of the alloying elements falls within a predetermined range in the steel-making step by check analysis, to calculate the δ-ferrite value according to the formula, and to make any necessary adjustment of each alloying element to within the predetermined range so as to assure that the δ-ferrite value falls within the specified range.

In the formula, the austenite potential is subtracted from the ferrite potential, and when the δ-ferrite value calculated from the formula is positive, the value almost corresponds to the proportion, in percentage value, of the amount of the δ-ferrite phase (hereinafter termed as δ-ferrite amount) which actually precipitates in the present steel after cold rolling and annealing.

When we compare a steel showing a zero δ-ferrite value with a steel showing a value of −10, there is apparently no difference in respect to their base structure after cold rolling and annealing, but they do show quite different metallurgical properties. Thus, the former steel maintains barely a single austenite phase in its base structure, so that a small amount of δ-ferrite phase precipitates in the welded portion; on the other hand, the latter steel consistently maintains an austenite structure as in U.S. Pat. No. 3,754,898, so that the δ-ferrite phase does not precipitate on the welded portion any more. Therefore, while the steel having a δ-ferrite value of −10 shows a high sensitivity to weld cracking and is confronted with problems in actual welding practice, the steel having a δ-ferrite value of zero is free from such problem. Thus, the δ-ferrite value calculated as above represents the balance between the austenite and the ferrite in the steel and has a metallurgical significance even when the value is negative.

According to the present invention, the alloying elements are adjusted to obtain a calculated δ-ferrite value not less than zero in order to assure good weldability.

However, when the calculated δ-ferrite value exceeds 7.9%, the amount of the actual δ-ferrite increases correspondingly so that it is necessary to raise the temperature for the solid solution treatment in order to obtain good workability. Thus, the upper limit of the δ-ferrite value is set at 7.9%.

Generally, ferritic stainless steels containing about 2% Al tend to form a film of $Al_2O_3$ in an oxidizing atmosphere at high temperatures, while austenitic stainless steels containing Al in an amount as high as 5% or more do not form the $Al_2O_3$ film because of a small diffusion rate of Al in the austenite phase, so far as the steels are prepared by an ordinary process.

In U.S. Pat. No. 3,754,898, a large amount of Y in addition to Al is added, so that a film of $Al_2O_3$ can be formed on the surface of the austenitic steel, but on the other hand, the hot workability is thereby deteriorated.

The present inventors have discovered that the difficulty in forming the $Al_2O_3$ film on the steel as above can be attributed not only to the small diffusion rate of Al, but also to the internal oxide layer inevitably formed in this type of steel during hot working. The present inventors have made a further discovery that a uniform film of $Al_2O_3$ can be formed on an austenitic stainless steel containing 4.5% or more Al, without addition of rare earth elements such as Y, when the internal oxide layer is eliminated, and the present invention is based on these discoveries.

In case of Al-containing austenitic steel, an internal oxide layer composed mainly of $Al_2O_3$ is formed during the hot working step, in addition to the surfacial spinel oxide film which is an oxide of Cr or Fe. This internal oxide layer develops still deeper into the steel in the subsequent annealing step and AlN crystals are precipitated below this layer, but the steel surface looks clean after the steel is treated in the subsequent acid pickling step so that the steel is conventionally transferred directly to the next step.

In actuality, however, it has been revealed, as shown in FIG. 2(2) illustrating the cross-sectional structure, that the internal oxide layer (shown by B and C in the drawing) remains even after the acid pickling step. Therefore, when the steel is further subjected to cold rolling and annealing, the internal oxide layer further develops and remains just below the steel surface as shown in FIG. 2(3), while the spinel oxide film (shown by A in the photograph), which is an oxide of Fe.Ni.Cr, is formed on the steel surface. Therefore, even if a steel having an internal oxide layer as above is placed in a high temperature oxidizing atmosphere, Al diffusing from the internal portion to the surface is trapped by the internal oxide layer so that a surfacial film of $Al_2O_3$ can no longer be formed on the steel. In this case, the oxidation rate is similar to that in a conventional Al-containing austenitic steel.

The present inventors have discovered that a uniform film of $Al_2O_3$ is formed on an austenitic steel containing more than 4.5% Al, and results in a high degree of resistance to oxidation, when the internal oxide layer (shown by B and C in FIG. 2(3)) is completely eliminated before actual use. However, in actual practice, it is advantageous to measure the thickness of the internal oxide layer (shown by B and C in FIG. 2(2)) remaining just below the steel surface after the annealing and acid pickling steps following the final hot working step, and to remove the surfacial layer in a thickness slightly larger than this measured thickness by surface grinding. For illustrating one embodiment, a portion of a hot rolled steel after acid pickling is taken, and this portion is embedded in resin and ground on the cross section, the thickness of the internal oxide layer is measured, and the steel surfaces are subjected to more elaborate grinding than is conventional, by means of an ordinary coil grinder. The steel after the above treatment can be directly used for practical services, or it can be further subjected to cold rolling, annealing and acid pickling without formation of an internal oxide layer so that a cold rolled steel sheet showing the desired properties of the present invention can be obtained.

Meanwhile, the portion shown by D in FIGS. 2(2) and (3) represent an austenite phase containing a δ-ferrite phase (shown by the black portion in the photographs).

The $Al_2O_3$ film is formed as a protective oxide film when the steel of the present invention is used in a high-temperature oxidizing atmosphere, and maintains the required oxidation resistance. However, in some cases, depending on the final applications, the steel sheet, after being formed into a final form for application, should be heated at a high temperature in an oxidizing atmosphere so as to form the stable $Al_2O_3$ film, and thus the steel can stand against service in an atmosphere containing strongly corrosive substances.

The steel of the present invention, when subjected to 200 hours continuous heating at 1200° C., forms a uniform protective oxide film mainly composed of alpha-$Al_2O_3$ of several micron thickness, as clearly illustrated by the subsequent examples, shown by F in FIG. 2(4). The portion shown by G in the photograph is an austenite phase in which some TiN precipitates. This protective oxide film prevents oxidation loss of the steel and also contributes to the prevention of nitrogen coming into the inner portion of the steel at high temperatures. In addition, as the growing speed of the alpha-$Al_2O_3$ is very slow, the aluminum content in the steel does not decrease even when the steel is subjected to a long period of heating, thus maintaining the protecting effect of the film.

The reasons for limiting the amounts of individual elements in the steel composition according to the present invention will be explained below.

Carbon is an austenite forming element and enhances the high-temperature strength, but excessive carbon contents, i.e. more than 0.2%, cause precipitation of a large amount of chromium carbide, which transforms into a sigma phase and embrittles the steel during service at a temperature between 600° and 900° C., and causes fin cracking during hot working, and thus workability and toughness are deteriorated. Therefore, the upper limit of carbon is set at 0.2%.

Silicon improves the oxidation resistance as its content increases. However, in case of the steel of the present invention, satisfactory oxidation resistance is assured by the $Al_2O_3$ film so that reinforcement of oxidation resistance by the high silicon content is not necessary. On the other hand, silicon is a ferrite forming element, and excessive silicon contents, i.e. more than 1%, decrease workability, weldability and toughness of the steel. Therefore, the upper limit of the silicon content is set at 1.0%.

Manganese is an austenite forming element, but tends to deteriorate oxidation resistance of the steel when it exists in an excessive amount, i.e. more than 2%, and thus the upper limit of the manganese content is set at 2.0%.

Nickel is one of the basic elements which is essential for the austenitic steel of the present invention, and also essential for maintaining the desired high-temperature strength and creep strength. Not less than 12% of nickel is required even when chromium and aluminum, which are ferrite formers, are present in their minimum amounts. Therefore, the lower limit of the nickel content is set at 12%. Meanwhile, when chromium and aluminum are present in their maximum amounts, not less than 37% of Ni is required. Therefore, the upper limit of the nickel content is set at 37%.

However, in order to maintain a high degree of high-temperature strength and creep strength at high temperatures of 1000° C. or higher, an increased nickel content is required, and for this purpose, it is desirable to add not less than 22% of nickel.

Chromium, as well as aluminum, is a basic element essential for desired high-temperature oxidation resistance, and also essential for assuring a level of ductility and toughness similar to that obtained by ordinary steel sheets in spite of the large content of aluminum. For these reasons, not less than 9% of chromium is required in the present invention. On the other hand, chromium contents beyond 25% require an increased addition of nickel, and cause greater tendency toward sigma embrittlement and formation of a new phase close to the delta ferrite phase during a long period of heating at high temperatures, which promotes deterioration of the steel. Therefore, the chromium content is limited to the range of from 9 to 25%.

Aluminum is added in an amount of more than 4.5% for forming a uniform $Al_2O_3$ film on the surface of an austenitic steel which has been completely removed of the internal oxide layer formed during the hot working step. When the aluminum addition is less than 4.5%, the film thus formed is composed mainly of spinel oxides of Fe, Cr and Ni, and even if an $Al_2O_3$ film is initially formed, it is gradually replaced by a spinel oxide film during service at high temperatures, or $Al_2O_3$ is produced only partially, failing to provide a uniform and stable film.

On the other hand, as aluminum is a strong ferrite former, aluminum additions exceeding 6% cause an increased amount of delta ferrite, thus increasing the adverse effect of the binary-phase steel, and lowering the toughness of the steel. Therefore, the aluminum content is limited to within the ranges of from more than 4.5% to 6%.

Titanium, niobium and zirconium fix the carbon and sulfur and are effective to prevent precipitation of chromium carbide and sulfide at the grain boundaries, and thus are effective to prevent fin cracking during hot working. Furthermore, titanium and zirconium disperse in and/or near the $Al_2O_3$ film to strengthen the film. In any case, when these elements are added in an amount exceeding 0.8%, the steel is embrittled. Therefore, the upper limit of these elements is set at 0.8%.

In the present invention, due consideration is given to the surface condition of the steel at the initial oxidation stage, so that it is not necessary to add rare earth elements such as Y in order to form the $Al_2O_3$ film at high temperatures, but rare earth elements, such as yttrium, cerium and lanthanum, are effective to reinforce oxidation resistance and also to improve hot workability. However, when these elements are added in an amount beyond 0.08%, the hot workability is deteriorated and it is no longer possible to produce the steel on a mass-production scale by roll-breaking, as shown in Example 5. Therefore, their upper limit is set at 0.08%.

There is no specific limitation regarding the contents of phosphorus, sulfur and nitrogen. However, it is desirable to maintain these elements as low as possible to decrease the sensitivity to cracking during welding and to improve other properties.

Further, the steel according to the present invention can be still further improved in respect to hot workability and oxidation resistance by deoxidation with calcium and magnesium.

The present invention will be more clearly understood from the following description of preferred embodiments.

EXAMPLE 1

Steel samples No. 1 to No. 12 having the compositions shown in Table 1 were melted, forged, hot rolled, annealed, pickled, sufficiently ground to remove the internal oxide layer, cold rolled and subjected to solution heat treatment to obtain finished cold rolled steel sheets of 1.5 mm thickness. Various properties of these steel sheets are compared with those of steel samples No. 13 to No. 17, which are conventional steels of the same thickness.

After the steel samples were cut to a size of 1.5×20×50 mm, and finished with No. 600-grit emery paper, they were oxidized at 1200° C. for 20 hours in air, and the oxidation weight increase was measured continuously by a thermobalance. The results are graphically shown in FIG. 1 in which the numerical references indicate the sample number. As shown by the graph, the conventional austenitic steels, i.e. Ni-Cr-Al steel, AISI 310S, and Incolloy 800, show relatively high oxidation weight increases, while the oxidation weight increases of the steels (NO. 1–No. 12) of the present invention and the Fe-Cr-Al steel (No. 17) fall within the range marked with slanted lines, and thus are remarkably less than those of the conventional austenitic heat-resistant steels (No. 13–No. 16). The test pieces of the conventional heat-resistant steels after the tests are black, while those of the present invention are all brown, just as the Fe-Cr-Al steel. These results suggest that the oxidation mechanism of the steels of the present invention is almost the same as in the case of the Fe-Cr-Al steel.

Some of the steel samples were subjected to treatment at 1200° C. for 200 hours in air and the films thus formed were identified by X-ray diffractometer. The film thickness was measured by means of cross-section polishing of these samples mounted in resin, and further the precipitates were identified by EPMA.

The results are shown in Table 2. The microstructures near the surface of the steel sample No. 2 (present invention-1) and the steel sample No. 13 (conventional Ni-Cr-Al steel) are shown respectively in FIG. 2(4) and FIG. 2(1) to illustrate typical metal structures of the steel samples. FIG. 2(1) is a photograph of 100 magnifications while FIG. 2(4) is a photograph of 400 magnifications.

Table 1

| | | Chemical Composition of Steels (wt %) | | | | | | | | | | | | |
|---|---|---|---|---|---|---|---|---|---|---|---|---|---|---|
| | | C | Si | Mn | Ni | Cr | Al | Ti | Nb | Zr | Y | Ce | La | δ-Ferrite Value |
| 1 | Present Invention-1 | 0.041 | 0.81 | 1.02 | 15.2 | 9.8 | 4.96 | 0.41 | — | — | — | — | — | 6.5 |
| 2 | Present Invention-1 | 0.076 | 0.53 | 1.04 | 22.3 | 15.7 | 4.76 | 0.42 | — | — | — | — | — | 1.5 |
| 3 | Present Invention-1 | 0.057 | 0.47 | 1.02 | 24.2 | 18.5 | 4.68 | 0.38 | — | — | — | — | — | 3.7 |
| 4 | Present Invention-1 | 0.052 | 0.57 | 1.05 | 28.6 | 23.1 | 4.60 | 0.41 | — | — | — | — | — | 5.0 |
| 5 | Present Invention-1 | 0.121 | 0.51 | 0.87 | 21.5 | 17.6 | 5.28 | 0.17 | 0.20 | — | — | — | — | 7.3 |
| 6 | Present Invention-1 | 0.015 | 0.32 | 0.45 | 33.1 | 23.4 | 5.83 | 0.34 | — | 0.14 | — | — | — | 2.3 |
| 7 | Present Invention-1 | 0.014 | 0.11 | 0.60 | 30.4 | 24.3 | 5.40 | — | — | 0.29 | — | — | — | 7.8 |
| 8 | Present Invention-1 | 0.042 | 0.79 | 0.48 | 22.6 | 12.7 | 5.62 | 0.15 | 0.09 | 0.10 | — | — | — | 0.1 |
| 9 | Present Invention-2 | 0.023 | 0.25 | 1.07 | 22.8 | 18.0 | 5.05 | — | 0.25 | 0.18 | 0.02 | — | — | 7.9 |
| 10 | Present Invention-2 | 0.043 | 0.60 | 1.06 | 23.7 | 18.8 | 4.85 | 0.20 | — | 0.22 | — | 0.03 | — | 7.8 |
| 11 | Present Invention-2 | 0.058 | 0.52 | 1.07 | 25.6 | 21.2 | 4.52 | 0.35 | — | — | — | 0.02 | 0.01 | 6.9 |
| 12 | Present Invention-2 | 0.074 | 0.43 | 0.52 | 22.9 | 15.2 | 5.27 | 0.30 | — | — | 0.04 | 0.02 | — | 0.8 |
| 13 | Conventional Ni—Cr—Al Steel | 0.073 | 0.21 | 1.21 | 23.8 | 22.6 | 1.97 | 0.28 | — | — | — | — | — | −6.5 |
| 14 | Conventional Ni—Cr—Al Steel | 0.023 | 0.54 | 0.27 | 29.3 | 27.9 | 3.59 | 0.24 | — | 0.22 | — | 0.03 | — | 10.8 |
| 15 | AISI 310S | 0.052 | 0.74 | 0.91 | 20.3 | 25.2 | — | — | — | — | — | — | — | −5.0 |
| 16 | Incolloy 800 | 0.005 | 0.42 | 1.31 | 31.9 | 20.5 | 0.45 | 0.56 | — | — | — | — | — | −44.2 |
| 17 | Fe—Cr—Al Steel | 0.018 | 0.10 | 0.12 | — | 21.8 | 2.4 | 0.32 | — | — | — | — | — | 100* |

Remarks:
(1) The δ-ferrite value was calculated from the formula as previously discussed.
(2) For calculation of the δ-ferrite value, the content of N was set at 0.02% in all cases.
(3) *Actually measured value.

Table 2

| | | Films Formed after Heating at 1200° C. for 200 Hours in Air; Identification of Precipitates and Thickness of Oxide Films | | | |
|---|---|---|---|---|---|
| | | Identification of Film Substances | | Thickness | |
| | Sample No. | Main Components | Minor Components | of oxide film (μ) | Precipitates |
| 2 | Present Invention-1 | α-$Al_2O_3$ | $NiCr_2O_4$, $Fe_3O_4$, $Cr_2O_3$ | 5–7 | TiN |
| 5 | Present Invention-1 | " | $NiCr_2O_4$, $Fe_3O_4$, $Cr_2O_3$ | 4–7 | " |
| 7 | Present Invention-1 | " | $NiCr_2O_4$, $Fe_3O_4$, $Cr_2O_3$ | 4–7 | " |
| 10 | Present Invention-2 | " | $NiCr_2O_4$, $Fe_3O_4$, $Cr_2O_3$ | 4–6 | " |
| 12 | Present Invention-2 | " | $NiCr_2O_4$, $Fe_3O_4$, $Cr_2O_3$ | 4–6 | " |
| 13 | Conventional Ni—Cr—Al Steel | $(Fe . Cr)_3O_4$ | α-$Fe_2O_3$, $Cr_2O_3$ | ~140* | TiN, $Al_2O_3$, AlN |
| 16 | Incolloy 800 | " | " | 60–70* | TiN, $Al_2O_3$, AlN |

*Indicates the thickness of the oxide film including the internal oxide layer

As shown by the above results, the steels according to the present invention form a surfacial film of 4–7 microns in thickness, mainly composed of alpha-$Al_2O_3$, when heated at 1200° C. for 200 hours in air, and TiN, though in a small amount, precipitates in the austenite grains in the matrix.

On the other hand, in the case of the conventional Ni-Cr-Al steel, a thick internal oxide layer mainly composed of $Al_2O_3$ is formed below a film mainly composed of $(Fe\text{-}Cr)_3O_4$, and large grains of AlN precipitate in a considerable amount together with TiN in the matrix.

It is clearly understood from the above facts that the oxide film of several micron thickness formed on the surface of the steel of the present invention supresses oxidation and nitrization of the steel during high-temperature heating and acts as an excellent protective film.

EXAMPLE 2

For determination of the applicability of the steel of the present invention to an automobile exhaust gas-purifying device, some of the steel samples shown in Table 1 were subjected to cyclic heating tests in an electric furnace maintained at 1200° C., into which exhaust gas from a gasoline engine and air for secondary combustion were introduced from one side of the furnace core tube.

Figure 3:
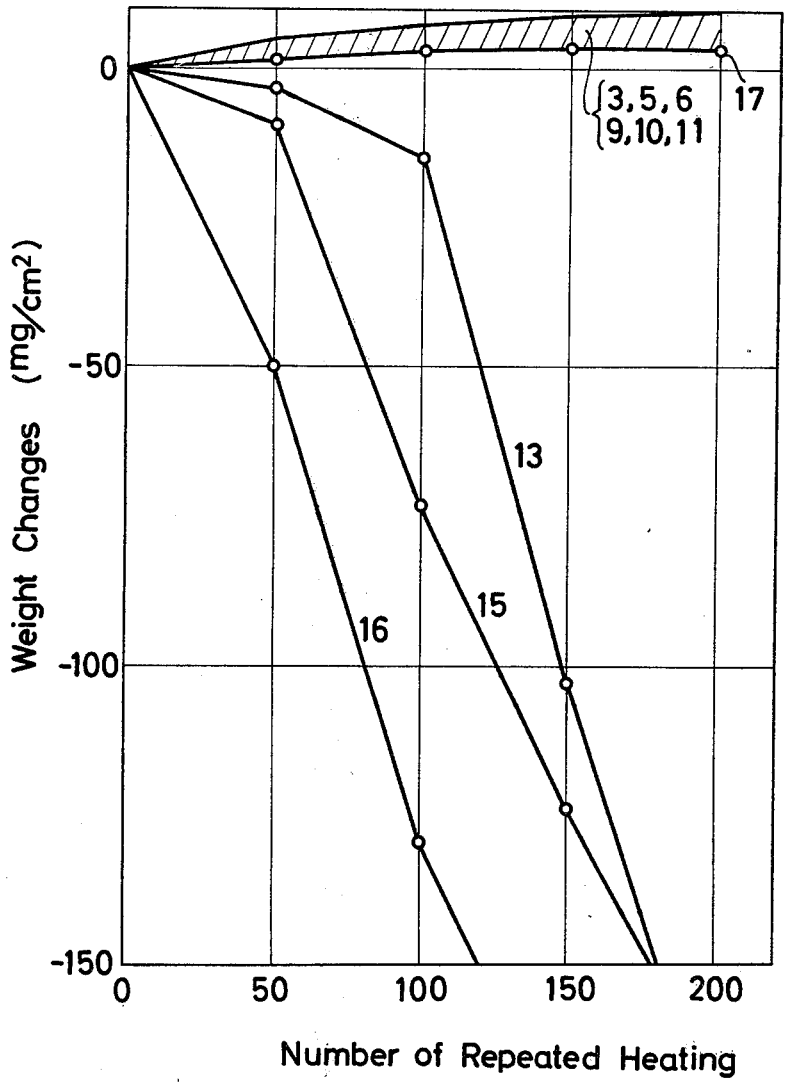
FIG. 3 is a graph showing weight changes of various steel samples when subjected to cyclic heating at 1200° C. in the exhaust gas from an automobile engine.

The steel samples were cut to a size of 1.5×20×50 mm, finished in No. 600-grit emery paper, and then washed. These samples thus prepared were subjected to a cycle of heating for 30 minutes in the furnace and cooling for the succeeding 30 minutes in air. The weight changes of the samples were measured each 50 cycles, and the results are shown in FIG. 3.

As shown by the graph, the conventional austenitic steels show considerable weight decreases, thus indicating severe spalling.

On the other hand, the weight change of the steel samples of the present invention fall within the range marked by the slanted lines, with its lower limit being defined by the curve of the Fe-Cr-Al steel (No. 17), thus demonstrating very excellent oxidation resistant against cyclic heating in a high-temperature corrosive atmosphere.

Also, weight changes of the steel samples of the present invention after 200 cycles of cyclic heating at 1200° C. in the exhaust gas are shown in Table 3. As shown by the table, the weight change of the steels of the present invention-2, containing the rare earth elements, is small as compared with that of the steels of the present invention-1. This indicates the former steels have even more excellent oxidation resistance than the latter steels.

Table 3

| Samples | | Weight Changes after 200 Cycles of Heating at 1200° C. in Exhaust Gas: Cr (approx. %) | Weight changes ($mg/cm^2$) |
|---|---|---|---|
| 3 | Present Invention-1 | 18 | +9.6 |
| 5 | " | " | +7.7 |
| 6 | " | 23 | +4.1 |
| 9 | Present Invention-2 | 18 | +3.9 |

Table 3-continued

| Samples | | Weight Changes after 200 Cycles of Heating at 1200° C. in Exhaust Gas: Cr (approx. %) | Weight changes ($mg/cm^2$) |
|---|---|---|---|
| 10 | " | 19 | +4.2 |
| 11 | " | 21 | +3.6 |
| 17 | Fe—Cr—Al Steel | 22 | +3.1 |

EXAMPLE 3

Tensile test pieces according to JIS 13-B were taken from cold rolled steel sheets of 1.5 mm thickness made from the various steel compositions shown in Table 1, and subjected to tensile tests at room temperature and to Erichsen tests.

Also the steel sheets were heated at 1150° C. for 300 hours in air, and similar tensile test pieces were taken therefrom and subjected to tensile tests at room temperature to determine the deterioration of the steel due to the lengthy high-temperature heating. The results are shown in Table 4. As clearly shown by the table, the steels of the present invention show elongation of more than 30% and Erichsen values of more than 10 mm, in spite of their high aluminum contents. This means the steels of the present invention can be worked as easily as ordinary steel sheets.

Also in respect to the elongation after heating at 1150° C. for 300 hours, the conventional Ni-Cr-Al steels (No. 13 and No. 14) and the Fe-Cr-Al steel (No. 17) show considerable deterioration, whereas some of the steels of the present invention show rather increased elongation, and others show only slight deterioration, and all of the steels of the present invention show elongation of more than 31%. Observations of the metal structure of these steels after lengthy heating at high temperature revealed that considerable TiN and AlN precipitate in the matrix in case of the conventional Ni-Cr-Al steels, while excessive grain growth was seen in the Fe-Cr-Al alloy, and it is supposed these phenomena are closely related to the deteriorations of elongation as mentioned above. On the other hand, in the case of the steels of the present invention, no AlN was precipitated in the metal, only a small amount of TiN was observed to precipitate in the metal, and this amount was still smaller in the steels containing the rare earth elements according to the present invention-2.

As clearly understood from the above examples and results, the steels within the scope of the present invention can be worked and treated as easily as ordinary steel sheets, and the dense $Al_2O_3$ film can prevent oxidation and nitrization during heating at a high temperature for a long time, thus minimizing the deterioration of the material quality.

Table 4

| | Steels | Mechanical Properties of Steels and Changes therein after Heating at 1150° C. for 300 Hours: Tensile Properties (ordinary temp.): Yield Strength ($kg/mm^2$) | Tensile Strength ($kg/mm^2$) | Rupture Elongation (%) | Erichsen Value (mm) | Elongation after heating at 1150° C. for 300 hours: Rupture Elongation (%) | Percentage of elongation to that of non-heated steels (%) |
|---|---|---|---|---|---|---|---|
| 1 | Present Invention-1 | 33.0 | 76.2 | 32.0 | 10.5 | 33.7 | 105 |
| 2 | Present Invention-1 | 31.2 | 71.8 | 37.4 | 11.2 | 36.2 | 97 |
| 3 | Present | 32.8 | 73.1 | 35.9 | 11.0 | 36.1 | 101 |

Table 4-continued

| | Steels | Mechanical Properties of Steels and Changes therein after Heating at 1150° C. for 300 Hours: Tensile Properties (ordinary temp.) Yield Strength (kg/mm²) | Tensile Strength (kg/mm²) | Rupture Elongation (%) | Erichsen Value (mm) | Elongation after heating at 1150° C. for 300 hours: Rupture Elongation (%) | Percentage of elongation to that of non-heated steels (%) |
|---|---|---|---|---|---|---|---|
| 4 | Invention-1 Present | 32.5 | 74.2 | 35.2 | 11.0 | 36.9 | 105 |
| 5 | Invention-1 Present | 34.1 | 80.3 | 30.9 | 10.2 | 31.6 | 102 |
| 6 | Invention-1 Present | 30.8 | 69.4 | 40.3 | 11.1 | 41.5 | 103 |
| 7 | Invention-1 Present | 34.7 | 82.0 | 30.5 | 10.1 | 31.4 | 103 |
| 8 | Invention-1 Present | 28.5 | 65.2 | 40.7 | 11.3 | 40.0 | 98 |
| 9 | Invention-1 Present | 37.2 | 81.7 | 32.8 | 10.3 | 33.5 | 102 |
| 10 | Invention-2 Present | 33.8 | 79.2 | 30.8 | 10.2 | 33.2 | 108 |
| 11 | Invention-2 Present | 32.4 | 78.2 | 31.6 | 10.5 | 33.5 | 105 |
| 12 | Invention-2 Present | 28.0 | 64.4 | 41.2 | 11.7 | 40.8 | 99 |
| 13 | Invention-2 Conventional Ni—Cr—Al steel | 27.8 | 61.0 | 47.0 | 12.8 | 26.0 | 55 |
| 14 | Conventional Ni—Cr—Al steel | 31.2 | 82.4 | 22.3 | 7.7 | 17.4 | 78 |
| 15 | AISI 310S | 27.1 | 56.0 | 41.5 | 11.5 | 42.2 | 102 |
| 16 | Incolloy 800 | 22.4 | 57.9 | 43.0 | 11.8 | 36.9 | 86 |
| 17 | Fe—Cr—Al steel | 38.5 | 54.5 | 27.8 | 10.2 | 5.2 | 19 |

EXAMPLE 4

In order to determine the weldability of the steels of the present invention, some of the steel samples shown in Table 1 were subjected to Tigama Jig Cracking tests. This test measures the sensitivity of the deposited metal to high temperature cracking, which is peculiar to the austenitic steels. The center portion of a steel sheet restrained along the circumference is fused by TIG torch, and immediately after the arc is stopped a certain amount of strain is imparted to the sheet from the lower side by a spherical punch, and the ratio of the length of the crack thus caused to the diameter of the molten pond was obtained to estimate the sensitivity to cracking during welding. The measurement was done with 5 A of arc current, 5 seconds of current passage, argon shielding and 1.0% of added strain, and the crack length was measured by a microscope at 30 times magnification. The results are shown in FIG. 4.

Figure 4:
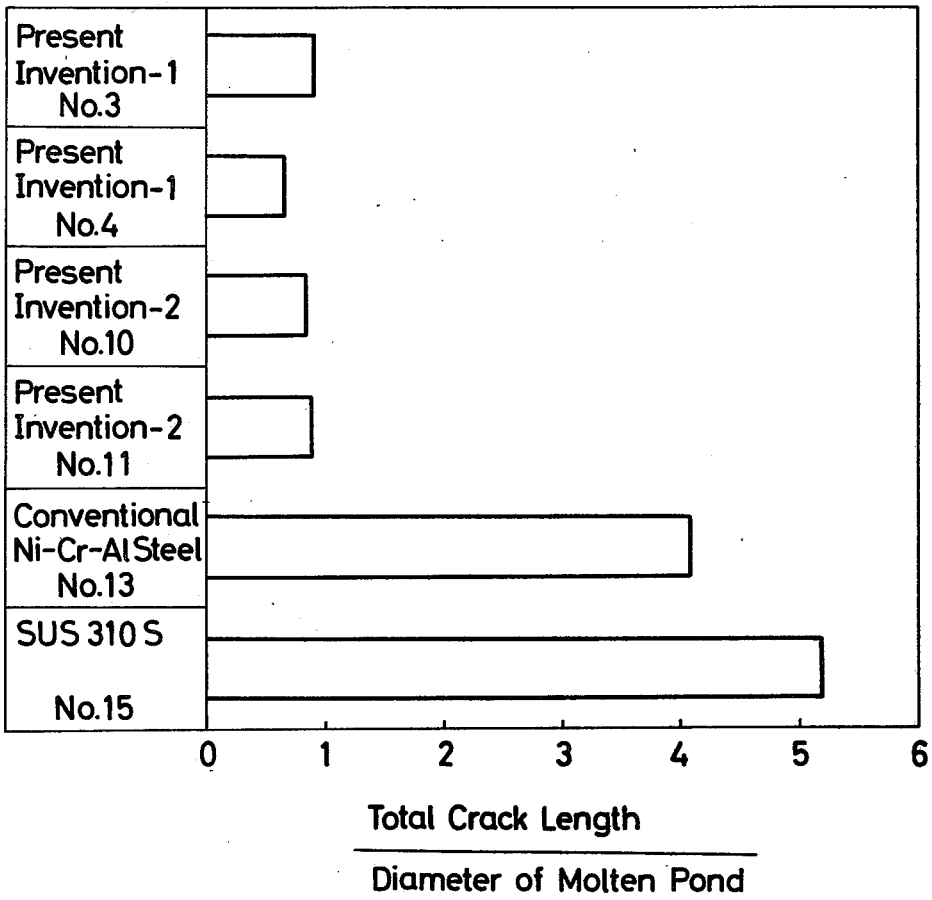
FIG. 4 is a graph showing sensitivity to cracking during welding of various steel samples.

As clearly understood from FIG. 4, the steels of the present invention show far less sensitivity to cracking during welding than the conventional Ni-Cr-Al steel and AISI 310S steel. Therefore, the steels of the present invention can be welded as easily and safely as ordinary steel sheets.

EXAMPLE 5

Stainless steels for general purpose are usually hot rolled after roll-breaking of ingots of several tons into slabs. In order to perform the roll-breaking without trouble, the steel is required to have a high level of hot workability. In order to determine the critical amount of Y which can stand the roll-breaking for the steel composition according to the present invention, 100 kg ingots containing various amounts of Y were prepared and subjected to roll-breaking. Regarding alloying elements other than Y, the molten heat was prepared aiming at 0.05% C, 0.5% Si, 1.0% Mn, 23% Ni, 16% Cr, 5.0% Al and 0.3% Ti, and the ingots were heated to 1200° C. for the roll-breaking. The results of the roll-breaking are shown in Table5, and as apparent therefrom, the steels containing 0 to 0.08% Y can be readily broken down into slabs of 30 mm in thickness without any problem, while the steels containing 0.1% or more Y are susceptible to fin cracking or overall cracking during the breaking down, resulting in successive occurrence of operational problems. Generally, a steel which is susceptible to fin cracking in the form of a 100 kg ingot cannot be adapted to mass production by using a large ingot, because the tendency of cracking increases as the size of the ingot increases.

Table 5

| Results of Roll-Breaking of Steels Containing Various Y contents: Y Content (%) | Results |
|---|---|
| 0 | No problem |
| 0.02 | " |
| 0.05 | " |
| 0.08 | " |
| 0.10 | Considerable fin cracking |
| 0.12 | Severe fin cracking |
| 1.03 | Overall cracking with several passes of rolling |

As shown by the above five examples, the steels of the present invention form a uniform film mainly composed of $Al_2O_3$ on their surface in a high-temperature oxidizing atmosphere and maintain the film stably so that excellent resistance against oxidation and corrosion at high temperature is assured, material deterioration during service at high temperatures is very slight, and welding and working can be done as easily and safely as in the case of ordinary steel sheets. In addition, the steels of the present invention are basically austenitic heat-resistant steels which naturally show high-temperature strength and creep strength as high as ordinary austenitic stainless steels. Therefore, the steels of the present invention are very useful for exhaust gas-purifying devices such as automobile thermal reactors, radiant tubes, reactors, heating elements and other structures and parts exposed to a high-temperature corrosive atmosphere. The steels of the present invention may be prepared by various melting methods, such as vacuum melting, as well as ordinary melting in an electric furnace, a convertor, and an electro-slag remelting method (ESR), and an ordinary ingot making method or continuous casting. Further, the steels of the present invention may be used in various forms such as cold rolled products, as well as hot worked products including hot extruded tubes and Mannesmann tubes, etc.

What is claimed is:

1. An austenitic heat-resistant steel which is capable of forming a film mainly composed of $Al_2O_3$ when heated in a high-temperature oxidizing atmosphere, said steel consisting essentially of, on a weight basis, not more than 0.2% of C, not more than 1.0% of Si, not more than 2.0% of Mn, 12 to 37% of Ni, 9 to 25% of Cr, more than 4.5 but not more than 6% of Al, not more than 0.8%, in total, of at least one member selected from the group consisting of Ti, Nb and Zr, and a positive amount of at least one rare earth element in a total amount of not more than 0.08%, the balance of said steel being Fe, said steel being removed of an internal oxide layer which has been formed just below the steel surface during hot working, said steel having a δ-ferrite value of from zero to 7.9 calculated on the basis of the formula $$\delta\text{-ferrite value} = 3.0\{(\%Cr) + 1.5(\%Si) + 2.5(\%Al)\} - 2.8[(\%Ni) + 0.5(\%Mn) + 30\{(\%C) + (\%N) - 12\Sigma \frac{Wi}{Mi}\}] - 19.8$$

where Wi and Mi represent, respectively, the percent by weight and the atomic weight of Ti, Nb and Zr, and when the term $$\{(\%C) + (\%N) - 12\Sigma \frac{Wi}{Mi}\}$$

is negative, said term is regarded as zero.

2. A steel according to claim 1, containing at least one rare earth element selected from the group consisting of La, Ce and Y in a total amount of not more than 0.08%.

3. A steel according to claim 1, wherein said steel contains 22–37% of Ni.

4. A steel obtained by heating the steel of claim 1, in an oxidizing atmosphere, at a temperature sufficient to form a stable $Al_2O_3$ film on the surface of said steel.

5. An austenitic heat-resistant steel which is capable of forming a film mainly composed of $Al_2O_3$ when heated in a high-temperature oxidizing atmosphere, said steel consisting of, on a weight basis, not more than 0.2% of C, not more than 1.0% of Si, not more than 2.0% of Mn, 12 to 37% of Ni, 9 to 25% of Cr, more than 4.5 but not more than 6% of Al, not more than 0.8%, in total, of at least one member selected from the group consisting of Ti, Nb and Zr, and a positive amount of at least one rare earth element in a total amount of not more than 0.08%, the balance of said steel being Fe, said steel being removed of an internal oxide layer which has been formed just below the steel surface during hot working, said steel having a δ-ferrite value of from zero to 7.9 calculated on the basis of the formula $$\delta\text{-ferrite value} = 3.0\{(\%Cr) + 1.5(\%Si) + 2.5(\%Al)\} - 2.8[(\%Ni) + 0.5(\%Mn) + 30\{(\%C) + (\%N) - 12\Sigma \frac{Wi}{Mi}\}] - 19.8$$

where Wi and Mi represent, respectively, the percent by weight and the atomic weight of Ti, Nb and Zr, and when the term $$\{(\%C) + (\%N) - 12\Sigma \frac{Wi}{Mi}\}$$

is negative, said term is regarded as zero.

6. A steel according to claim 1, containing at least one rare earth element selected from the group consisting of La, Ce and Y in a total amount of not more than 0.08%.

7. A steel according to claim 1, wherein said steel contains 22–37% of Ni.

8. A steel obtained by heating the steel of claim 1, in an oxidizing atmosphere, at a temperature sufficient to form a stable $Al_2O_3$ film on the surface of said steel.

* * * * *